United States Patent [19]

Iseya et al.

[11] Patent Number: 4,597,881

[45] Date of Patent: Jul. 1, 1986

[54] PROCESS FOR PRODUCING A LITHIUM-SOAP GREASE

[75] Inventors: Akira Iseya; Takekatsu Kita; Makoto Ikeda, all of Ichihara, Japan

[73] Assignee: Idemitsu Kosan Company Limited, Tokyo, Japan

[21] Appl. No.: 769,844

[22] Filed: Aug. 26, 1985

Related U.S. Application Data

[63] Continuation-in-part of Ser. No. 605,569, Apr. 30, 1984, abandoned.

[30] Foreign Application Priority Data

May 10, 1983 [JP] Japan ..... 58-80112

[51] Int. Cl.[4] ..... C10M 113/08

[52] U.S. Cl. ..... 252/41; 252/18; 252/25; 252/42.1

[58] Field of Search ..... 252/41, 18, 25, 42.1

[56] References Cited

U.S. PATENT DOCUMENTS

| | | | |
|---|---|---|---|
| 3,681,242 | 8/1972 | Gilani et al. | 252/41 |
| 3,791,973 | 2/1974 | Gilani et al. | 252/41 |
| 4,435,299 | 3/1984 | Carley et al. | 252/41 |
| 4,444,669 | 4/1984 | Wittse, Jr. et al. | 252/41 |
| 4,536,306 | 8/1985 | Peheer et al. | 252/41 |

*Primary Examiner*—William R. Dixon, Jr.

*Assistant Examiner*—E. M. McAvoy

*Attorney, Agent, or Firm*—Frishauf, Holtz, Goodman & Woodward

[57] ABSTRACT

A process for producing a lithium-soap grease which comprises:

adding a hydroxy-fatty acid having from 12 to 24 carbon atoms, and a dicarboxylic acid having from 8 to 10 carbon atoms to a base oil (I) having an aniline point of from 110° to 130° C. at a temperature of less than 100° C. with stirring to prepare a uniform dispersion of said acids in the base oil (I);

adding lithium hydroxide to said uniform dispersion with stirring;

reacting said acids and lithium hydroxide and dehydrating by heating to a temperature of 195° to 210° C.;

cooling the reaction mixture to a temperature not higher than about 160° C. at a cooling rate of from about 20° to 80° C./hour; and adding a base oil (II) having an aniline point of from 130° to 140° C. to the reaction mixture for a period of from 10 seconds to 30 minutes in an amount so that the weight ratio of the base oil (I) to the base oil (II) is from 30:70 to 60:40 and the resulting mixture of the base oils (I) and (II) has a dynamic viscosity as determined at 100° C. of from 5 to 50 centistokes and an aniline point of from 125° to 135° C. to produce said lithium-soap grease.

12 Claims, No Drawings

PROCESS FOR PRODUCING A LITHIUM-SOAP GREASE

This application is a continuation-in-part of application Ser. No. 605,569, filed Apr. 30, 1984, now abandoned.

BACKGROUND OF THE INVENTION

Lithium-soap greases are widely used as all-purpose lubricants in industrial machines, cars, railroad trains, and so forth. These greases are usually prepared by adding hydroxy-fatty acid, dicarboxylic acid, and lithium hydroxide to a mineral oil component, and then reacting them by heating. This reaction, however, inevitably becomes complicated, since the rates of reaction of hydroxy-fatty acid and lithium hydroxide are different from those of dicarboxylic acid and lithium hydroxide and, furthermore, the solubilities of the resulting lithium soap or salt in the mineral oil are different from each other. Moreover, it is necessary to apply a heating operation several times during the process of the production of the lithium soap (see, for example, U.S. Pat. Nos. 3,791,973 and 3,681,242). This is apparently disadvantageous from a viewpoint of energy consumption.

SUMMARY OF THE INVENTION

As a result of extensive investigations to develop lithium-soap grease of good heat resistance and also a process for efficiently producing such lithium-soap grease, it has been found that the choice of a specific mineral oil component results in the formation of lithium-soap grease having good heat resistance and furthermore enables simplification of the process of production of the lithium-soap grease.

The present invention provides a process for producing a lithium-soap grease which comprises:

adding a hydroxy-fatty acid having from 12 to 24 carbon atoms, and a dicarboxylic acid having from 8 to 10 carbon atoms to a base oil (I) having an aniline point of from 110° to 130° C. at a temperature of less than 100° C. with stirring to prepare a uniform dispersion of said acids in the base oil (I);

adding lithium hydroxide to said uniform dispersion with stirring;

reacting said acids and lithium hydroxide and dehydrating by heating to a temperature of about 196° to 210° C.;

cooling the reaction mixture to a temperature not higher than about 160° C. at a cooling rate of from about 20° to 80° C./hour; and adding a base oil (II) having an aniline point of from 130° to 140° C. to the reaction mixture for a period of from 10 seconds to 30 minutes in an amount so that the weight ratio of the base oil (I) to the base oil (II) is from 30:70 to 60:40 and the resulting mixture of the base oils (I) and (II) has a dynamic viscosity as determined at 100° C. of from 5 to 50 centistokes and an aniline point of from 125° to 135° C. to produce said lithium-soap grease.

DETAILED DESCRIPTION OF THE INVENTION

The base oil constituting the lithium-soap grease product of the process of the present invention must be a mineral oil component having a dynamic viscosity as determined at 100° C. of from 5 to 50 centistokes, preferably from 10 to 30 centistokes and an aniline point of from 125° to 135° C., preferably from 125° to 133° C. The use of a base oil having the above-specified properties permits the production of lithium-soap grease having a high dropping point, i.e., good heat resistance.

If a base oil having a dynamic viscosity as determined at 100° C. of less than 5 centistokes is used, the evaporation loss the base oil during the reaction and dehydration increases. On the other hand, if a base oil having a dynamic viscosity as determined at 100° C. of in excess of 50 centistokes is used, the torque of a stirrer used in performing the reaction and dehydration undesirably increases. If a base oil having an aniline point of less than 125° C. is used, the dropping point of the resulting grease is not increased; the heat resistance of the grease is not sufficiently high and, furthermore, the process of production of the grease is rendered complicate and unsuitable for practical use.

Suitable examples of the base oil to be used in the production of the grease of the present invention include a hydrogenation product of a paraffin-base lubricant fraction, an $\alpha$-olefin polymer having from 20 to 100 carbon atoms, and a mixture thereof.

The proportion of the base oil in the grease of the present invention varies with the type of the base oil or lithium soap mixture, the desired properties of the grease, and so forth, and cannot be determined unconditionally. In general, the amount of the base oil is from 70 to 94% by weight, preferably from 80 to 90% by weight based on the weight of the ultimate grease.

The other essential component of the lithium-soap grease of the present invention is a lithium soap mixture derived from the reaction of lithium hydroxide and a mixture of hydroxy-fatty acid having from 12 to 24 carbon atoms and dicarboxylic acid having from 8 to 10 carbon atoms.

Lithium soap is prepared by the reaction of the hydroxy-fatty acid with lithium hydroxide. Similarly, upon reaction of the dicarboxylic acid with lithium hydroxide, a lithium salt is formed. In the present invention, the mixture of the lithium soap and lithium salt is referred to as a "lithium soap mixture".

The lithium soap is present in a water-insoluble fine fibrous form in the base oil and acts as a thickening agent. Any hydroxy-fatty acids can be used in the present invention as long as they have from 12 to 24 carbon atoms. Preferably they have from 16 to 22 carbon atoms. Typical examples include 9-hydroxy-stearic acid, 10-hydroxy-stearic acid, 12-hydroxy-stearic acid, 12-hydroxy-behenic acid, and 10-hydroxy-palmitic acid. Of these compounds, 12-hydroxy-stearic acid is suitable.

The lithium salt is effective in increasing the quality, especially heat stability of the grease. Any dicarboxylic acids can be used in the present invention as long as they have from 8 to 10 carbon atoms. Typical examples include suberic acid, azelaic acid, and sebacic acid. Of these compounds, azelaic acid is especially preferred.

The lithium-soap grease product of the process of the present invention comprises the above-described base oil and lithium soap mixture. The amount of the lithium soap mixture being added is usually sufficient to be from 6 to 30% by weight based on the weight of the grease. If the amount of the lithium soap mixture being added is in excess of 30% by weight, the consistency of the resulting grease is too low and the composition is not uniform. On the other hand, if it is less than 6% by weight, the consistency of the resulting grease is too high and thus it is not possible to prepare a grease having a high dropping point.

The lithium soap mixture is, as described above, derived from lithium hydroxide and a mixture of hydroxy-fatty acid having from 12 to 24 carbon atoms and dicarboxylic acid having from 8 to 10 carbon atoms. The ratio of the hydroxy-fatty acid to the dicarboxylic acid varies with the type of the base oil and so forth, and cannot be determined unconditionally. Usually the molar ratio of the dicarboxylic acid to the hydroxy-fatty acid (dicarboxylic acid/hydroxy-fatty acid) is from 0.75:1 to 1.10:1. If the molar ratio is less than 0.75:1, the resulting grease has a low dropping point, whereas if it is in excess of 1.10:1, the grease is not uniform in the composition and is inferior in the quality.

The amount of the hydroxy-fatty acid used is not subject to any special limitations; it is usually from 4 to 15% by weight based on the total weight of the starting materials, i.e., the base oil, hydroxy-fatty acid, dicarboxylic acid, and lithium hydroxide. Preferably it ranges between 6 and 12% by weight. The amount of the dicarboxylic acid used is usually from 1 to 10% by weight and preferably from 3 to 8% by weight, based on the total weight of the starting materials. It is sufficient for lithium hydroxide to be added in amounts to complete the reactions of lithium hydroxide with the hydroxy-fatty acid and dicarboxylic acid. Usually it is from 1 to 10% by weight based on the total weight of the starting materials and, furthermore, is added in an amount either equivalent to or slightly greater than the total amount of hydroxy-fatty acid and dicarboxylic acid.

The lithium-soap grease product of the process of the present invention, if desired, may contain additives such as antioxidants, anticorrosive agents, and extreme pressure additives. Examples of such antioxidants include phenyl-α-naphthylamine, nickel dibutyl-dithiocarbamate, zinc dibutyl-dithiocarbamate, dilauryl thiodipropionate, and dilauryl thiodipropionate. As anticorrosive agents, barium salts of alkylaromatic sulfonates can be used. As extreme pressure additives, sulfur/phosphorus-containing extreme pressure additives can be used.

The lithium-soap grease product of the process of the present invention has a very high dropping point, i.e., is of good heat resistance and, therefore, is effectively used in many applications.

The lithium-soap grease product of the process of the present invention is not limited in the process of production thereof and can be produced by any suitable procedures. Specifically, in accordance with the process of the present invention, the lithium-soap grease of such high performance can be produced with high efficiency.

The process of the present invention will hereinafter be explained in detail.

First, hydroxy-fatty acid having from 12 to 24 carbon atoms, dicarboxylic acid having from 8 to 10 carbon atoms, and lithium hydroxide are added to a base oil (I), which are then reacted and dehydrated. The amount of the base oil (I) used is from 30 to 60% by weight based on the total weight of the base oil (I) and a base oil (II) as described hereinafter. The base oil (I) should be chosen so that the resulting mixture of the base oils (I) and (II) has a dynamic viscosity as determined at 100° C. of from 5 to 50 centistokes, preferably from 10 to 30 centistokes, and an aniline point of from 125° to 135° C., preferably from 125° to 133° C.

The base oil (I) preferably has an aniline point ranging between 110° and 130° C., and more preferably has an aniline point ranging between 110° and 123° C. Also the dynamic viscosity as determined at 100° C. of the base oil (I) is preferably from 5 to 50 centistokes and more preferably from 10 to 30 centistokes. When the base oil (I) having desirable properties as described above is used in combination with the base oil (II) having desirable properties as described hereinafter, there can be obtained a lithium-soap grease which is greatly reduced in the decrease of the dropping point with a lapse of time and can be stably stored for long periods of time.

As the hydroxy-fatty acid and dicarboxylic acid to be added to the base oil (I), the same ones as described above for the production of the lithium-soap grease of the present invention can be used. The amount of the hydroxy-fatty acid used is from 4 to 15% by weight, preferably from 6 to 12% by weight, based on the total weight of the starting materials, the base oils (I) and (II), hydroxy-fatty acid, dicarboxylic acid, and lithium hydroxide. The amount of the dicarboxylic acid used is from 1 to 10% by weight, preferably from 3 to 8% by weight, based on the total weight of the starting materials. If the amount of the hydroxy-fatty acid used is less than 4% by weight, the consistency of the resulting grease is too high, whereas if it is in excess of 15% by weight, the consistency of the resulting grease is undesirably too low. If the amount of the dicarboxylic acid used is less than 1% by weight, the resulting grease has a dropping point of 260° C. or less and is low in heat resistance, whereas if it is in excess of 10% by weight, the resulting grease is undesirably not uniform in the composition.

In the process of the present invention, lithium hydroxide is usually added as a saturated hot aqueous solution of lithium hydroxide monohydrate. The amount of the lithium hydroxide used is sufficient to be capable of completing the reactions of lithium hydroxide and the above-described hydroxy-fatty and dicarboxylic acid. Specifically the amount of the lithium hydroxide used is within the range of from 1 to 10% by weight based on the total weight of the starting materials. More specifically, it is added in an amount, either equivalent to or slightly greater than, that of the hydroxy-fatty acid/dicarboxylic acid mixture.

Conditions under which the reaction between lithium hydroxide and a mixture of hydroxy-fatty acid and dicarboxylic acid is carried out are not critical and can be determined appropriately. For example, predetermined amounts of hydroxy-fatty acid and dicarboxylic acid are added to a predetermined amount of base oil (I), stirred at temperatures higher than the melting point of the hydroxy-fatty acid used, particularly in an open system at temperatures of less than 100° C., usually from 90° to 99° C., and preferably from 93° to 98° C., for a period of from about 30 to 100 minutes, preferably from about 40 to 100 minutes to prepare a uniform dispersion of said acids in the base oil (I) and, thereafter, a saturated hot aqueous solution of lithium hydroxide monohydrate is gradually added thereto over a period of from 40 to 100 minutes to prepare mixture. If the rate of addition of lithium hydroxide is too fast, the dropping point of the ultimate grease is low, whereas if it is too slow, the operation period is undesirably increased.

Subsequently the mixture is gradually heated over from 3 to 4 hours to the maximum processing temperature to achieve the reaction and dehydration. This maximum processing temperature is usually from 195° to 210° C. and preferably from 196° to 205° C. If the maximum processing temperature is less than 195° C., gelation occurs only insufficiently, resulting in the formation of a grease having a high consistency. On the other hand, if it is in excess of 210° C., the surface texture is not smooth, resulting in the formation of a grease having a bad appearance. The mixture should be maintained at the maximum processing temperature for a period of from about 10 to 20 minutes. The hydroxy-fatty acid is converted into the corresponding lithium soap, which is present in a water-insoluble fibrous form in the base oil, acting as a thickening agent. The dicarboxylic acid is converted into the corresponding lithium salt, playing an important role in increasing the heat resistance.

The dehydration is achieved, in an open system, merely by heating. In a closed system, water is removed from the reaction system by the use of, e.g., a vacuum pump.

After the reaction is completed, the reaction mixture should be cooled down. It is preferably cooled to 140° to 160° C. and more preferably to about 150° C. The cooling rate is from about 20° to 80° C./hour. When it is less than 20° C./hour, the dropping point of the grease is undesirably lowered. When it is over 80° C./hour, the dropping point is gradually lowered over a long lapse of time, and separation of the oil from the grease is liable to occur.

To the reaction mixture which as been cooled as described above, a base oil (II) is added to produce the desired lithium-soap grease. The base oil (II) is added to the reaction mixture for a period of from 10 seconds to 30 minutes, preferably from 1 to 10 minutes. The amount of the base oil (II) being used is chosen appropriately within the range that it is from 70 to 40% by weight based on the total weight of the base oils (I) and (II). That is, the weight ratio of the base oil (I) to the base oil (II) (base oil (II/base oil (II) is from 30:70 to 60:40 and preferably from 40:60 to 60:40. If the proportion of the base oil (I) is less than the above-specified lower limit, the resulting mixture is too viscous and is difficult to agitate. On the other hand, if it is in excess of the upper limit, the resulting grease is undesirably softened.

It is required for the base oil (II) to form a mineral oil component having a dynamic viscosity as determined at 100° C. of from 5 to 50 centistokes, preferably from 10 to 30 centistokes and an aniline point of from 125° to 135° C., preferably from 125° to 133° C., when mixed with the base oil (I) as described above. Thus the base oils (I) and (II) may be the same or different in respect of the mineral oil component. Both the base oils (I) and (II) may have properties satisfying the above-described requirements, or one or both of the base oils (I) and (II) may have properties not satisfying the requirements as long as the mixture of the base oil (I) and the base oil (II) meets the above-specifified conditions.

It is preferred for the base oil (II) to have an aniline point ranging between 130° and 140° C., although it is not subject to any special limitation on its properties. Also, preferably, it has a dynamic viscosity as determined at 100° C. of from 5 to 50 centistokes. When the base oil (II) having properties as described above is mixed with the base oil (I) having an aniline point of from 110° to 130° C and a dynamic viscosity as determined at 100° C. of from 5 to 50 centistokes in a ratio falling within the above-specified weight ratio range, the resulting mixture has an aniline point of from 125° to 135° C. and a dynamic viscosity as determined at 100° C. of from 5 to 50 centistokes.

The lithium-soap grease of the present invention can be produced by a procedure as described above. If desired, additives such as antioxidants, anticorrosive agents, and extreme pressure additives can be added to the lithium-soap grease. These additives can be added along with the base oil (II) or after the base oil (II) is added. As these additives, the same ones as listed above can be used.

The process of the present invention yields various advantages. For example, (1) a lithium-soap grease having a high dropping point can be produced with high efficiently; (2) since the reaction and dehydration is sufficient to be performed only once and also the heating operation is applied only once, the operation is simplified and, furthermore, the present process is of low energy consumption and advantageous from an economic standpoint; and (3) since the base oils (I) and (II) having the specified properties are used, there can be produced lithium-soap grease which has a high dropping point, and in which the decrease in the dropping point with a lapse of time is greatly reduced, and thus which can be stored stably for long periods of time.

The lithium-soap grease produced by the process of the present invention is very useful as lubricants to be used in industrial machines, cars, railroad trains, and so forth.

The present invention is described in greater detail with reference to the following examples.

EXAMPLE 1

(1) Preparation of Base Oil

The following oil ingredients were mixed to prepare a base oil having a dynamic viscosity at 100° C. of 14.7 centistokes and an aniline point of 128° C.

| | percents by weight |
|---|---|
| 500 Neutral oil (dynamic viscosity at 100° C.: 10.6 centistokes; viscosity index: 108; aniline point: 126° C.) (Component A) | 63 |
| Bright stock (dynamic viscosity at 100° C.: 30.9 centistokes; viscosity index: 109; aniline point: 145° C.) (Component B) | 27 |
| Naphthene mineral oil (dynamic viscosity at 100° C.: 12.7 centistokes; viscosity index: −38; aniline point: 67° C.) (Component C) | 10 |

(2) Production of Grease

The base oil prepared in (1) above was divided into two equal portions, a base oil (I) and a base oil (II). To the base oil (I), 12-hydroxy-stearic acid and azelaic acid were added in proportions of 8% by weight and 4.9% by weight, respectively, based on the total weight of the feedstocks, the molar ratio of 12-hydroxy-stearic acid to azelaic acid being 1:1, and the resulting mixture was stirred at 95° C. for 40 minutes. A saturated hot aqueous solution of lithium hydroxide was then added in proportion of 3.5% by weight based on the total weight of the feedstocks. The mixture was maintained at 95° C. for 60 minutes while stirring. The temperature of the mixture was gradually raised to 200° C. over 3.5 hours. Then the mixture was maintained at 200° C. for 15 minutes. At the end of the period, the mixture was cooled down to 150° C., at a cooling rate of 50° C./hour and the base oil (II) was added to the mixture over a period of 5 minutes, yielding a grease. This grease was measured for the dropping point. The results are shown in Table 1.

EXAMPLE 2

(1) Preparation of Base Oil

A base oil having a dynamic viscosity of 100° C. of 14.6 centistokes and an aniline point of 133° C. was prepared by mixing 73% by weight of Component A and 27% by weight of Component B as used in Example 1.

(2) Production of Grease

A grease was produced in the same manner as in (2) of Example 1 except that the base oil was replaced by the base oil prepared in (1) above. This grease was measured for the dropping point. The results are shown in Table 1.

COMPARATIVE EXAMPLE 1

(1) Preparation of Base Oil

A base oil having a dynamic viscosity at 100° C. of 15.2 centistokes and an aniline point of 120° C. was prepared by mixing 43% by weight of Component A, 27% by weight of Component B, and 30% by weight of Component C as used in Example 1.

(2) Production of Grease

A grease was produced in the same manner as in (2) of Example 1 except that the base oil was replaced by the base oil prepared in (1) above. This grease was measured for the dropping point. The results are shown in Table 1.

COMPARATIVE EXAMPLE 2

(1) Preparation of Base Oil

A base oil having a dynamic viscosity at 100° C. of 15.0 centistokes and an aniline point of 124° C. was prepared by mixing 53% by weight of Component A, 27% by weight of Component B, and 20% by weight of Component C as used in Example 1.

(2) Production of Grease

A grease was produced in the same manner as in (2) of Example 1 except that the base oil was replaced by the base oil prepared in (1) above. This grease was measured for the dropping point. The results are shown in Table 1.

TABLE 1

| Run No. | Dynamic Viscosity*1 (centistokes) | Aniline Point*2 (°C.) | Dropping Point*3 (°C.) |
|---|---|---|---|
| Example 1 | 14.7 | 128 | 260 |
| Example 2 | 14.6 | 133 | 283 |
| Comparative Example 1 | 15.2 | 120 | 223 |
| Comparative Example 2 | 15.0 | 124 | 244 |

*1Measured at 100° C.
*2Measured according to JIS K-2256.
*3Measured according to JIS K-2220.

EXAMPLES 3 TO 6 AND COMPARATIVE EXAMPLE 3

Greases were produced in the same manner as in (2) of Example 1 except that equal amounts of base oils (I) and (II) as shown in Table 2 were used. These greases were measured for the dropping point, just after the production and 6 months after the production. The results are shown in Table 2.

TABLE 2

| | Example | | | | Comparative |
|---|---|---|---|---|---|
| | 3 | 4 | 5 | 6 | Example 3 |
| Base Oil (I) | | | | | |
| Composition (wt %) | | | | | |
| Component A*1 | 90.1 | 80.2 | 70.3 | 53.0 | 60.4 |
| Component B*2 | 0 | 0 | 0 | 27.2 | 0 |
| Component C*3 | 9.9 | 19.8 | 29.7 | 19.8 | 39.6 |
| Dynamic Viscosity*4 (cst) | 11.2 | 11.4 | 11.6 | 14.9 | 11.9 |
| Aniline Point*5 (°C.) | 122.5 | 117.9 | 113.3 | 123.8 | 109.0 |
| Base Oil (II) | | | | | |
| Composition (wt %) | | | | | |
| Component A*1 | 35.7 | 45.6 | 45.6 | 72.8 | 45.6 |
| Component B*2 | 54.4 | 54.4 | 54.4 | 27.2 | 54.4 |
| Component C*3 | 9.9 | 0 | 0 | 0 | 0 |
| Dynamic Viscosity*4 (cst) | 19.4 | 19.2 | 19.2 | 14.7 | 19.2 |
| Aniline Point*5 (°C.) | 133.0 | 136.6 | 136.6 | 131.0 | 136.6 |
| Mixture of Base Oils (I) and (II) | | | | | |
| Dynamic Viscosity*4 (cst) | 14.7 | 14.7 | 14.8 | 14.8 | 14.9 |
| Aniline Point*5 (°C.) | 127.3 | 127.3 | 125.0 | 127.3 | 122.8 |
| Dropping Point*6 (°C.) | | | | | |
| Just after production | 272 | 278 | 264 | 268 | 240 |
| 6 Months after production | 267 | 271 | 260 | 252 | 239 |

*1500 Neutral oil (dynamic viscosity: 10.6 centistokes (100° C.); viscosity index: 108; aniline point: 126° C.).
*2Bright stock (dynamic viscosity: 30.9 centistokes (100° C.); viscosity index: 109; aniline point: 145° C.).
*3Naphthene mineral oil (dynamic viscosity: 12.7 centistokes (100° C.); viscosity index: −38; aniline point: 67° C.).
*4Measured at 100° C.
*5Measured according to JIS K-2256.
*6Measured according to JIS K-2220.

EXAMPLES 7 TO 9 AND COMPARATIVE EXAMPLES 4, 5

Greases were produced in the same manner as in EXAMPLE 4 except that the cooling rate was changed. These greases were measured for the dropping point, just after their production and 6 months after their production. The appearance of the greases was measured by evaluating with naked eyes the state of the surface of the greases after being stored in a 1 liter-volume can for 6 months. The results are shown in Table 3.

EXAMPLES 10 TO 12 AND COMPARATIVE EXAMPLES 6, 7

Greases were produced in the same manner as in EXAMPLE 5 except that the cooling rate was changed. These greases were measured for the dropping point, just after their production and 6 months after their production. The appearance of the greases was measured by evaluating with naked eyes the state of the surface of the greases after being stored in a 1 liter-volume can for 6 months. The results are shown in Table 4.

TABLE 3

| | EXAMPLE | | | COMPARATIVE EXAMPLE | |
|---|---|---|---|---|---|
| | 7 | 8*1 | 9 | 4 | 5 |
| Cooling Rate (°C./hour) | 25 | 50 | 75 | 12 | 100 |
| Dropping Point | | | | | |
| Just after production | 265 | 278 | 280 | 220 | 281 |
| 6 months after production | 263 | 271 | 272 | — | 266 |
| Appearance*2 | no | no | no | no | yes |

*1EXAMPLE 8 is the same as EXAMPLE 4.
*2"no" means that the separation of the oil from the grease did not occur.
"yes" means that the separation of the oil from the grease occurred.

TABLE 4

| | EXAMPLE | | | COMPARATIVE EXAMPLE | |
|---|---|---|---|---|---|
| | 10 | 11*1 | 12 | 6 | 7 |
| Cooling Rate (°C./hour) | 25 | 50 | 75 | 12 | 100 |
| Dropping Point | | | | | |
| Just after production | 260 | 264 | 268 | 210 | 270 |
| 6 months after production | 257 | 260 | 263 | — | 259 |
| Appearance*2 | no | no | no | no | yes |

*1EXAMPLE 11 is the same as EXAMPLE 5.
*2"no" means that the separation of the oil from the grease did not occur.
"yes" means that the separation of the oil from the grease occurred.

COMPARATIVE EXAMPLE 8

The same procedure as that of Example 3 was carried out except that the base oils (1) and (II) with properties shown in the following Table 5 were used.

To the base oil (I) shown in Table 5, 12-hydroxystearic acid and azelaic acid were added in proportions of 8% by weight and 4.9% by weight, respectively, based on the total weight of the feedstocks. The molar ratio of 12-hydroxystearic acid to azelaic acid was 1:1, and the resulting mixture was stirred at 95° C. for 40 minutes.

A saturated hot aqueous solution of lithium hydroxide was then added in proportion of 3.5% by weight based on the total weight of the feedstocks. The mixture was maintained at 95° C. for 60 minutes while stirring. The temperature of the mixture was gradually raised to 200° C. over 3.5 hours. Then the mixture was maintained at 200° C. for 15 minutes. At the end of the period, the mixture was rapidly cooled down to 150° C., and the base oil (II) shown in Table 5 was added to the mixture in the equal amount of the base oil (I), yielding a grease. This grease was measured for dropping point. The results are shown in Table 5 together with the results for Example 3.

TABLE 5

| | Comparative Example 8 | Example 3 |
|---|---|---|
| Base oil (I) | | |
| Composition (wt %) | | |
| Component A*1 | 40 | 90.1 |
| Component B*2 | 0 | 0 |
| Component C*3 | 60 | 9.9 |
| Dynamic Viscosity*4 (cSt) | 12.1 | 11.2 |
| Aniline Point*5 (°C.) | 90.0 | 122.5 |
| Base oil (II) | | |
| Composition (wt %) | | |
| Component A*1 | 30 | 35.7 |
| Component B*2 | 30 | 54.4 |
| Component C*3 | 40 | 9.9 |
| Dynamic Viscosity*4 (cSt) | 15.0 | 19.4 |
| Aniline Point*5 (°C.) | 110.4 | 133.0 |
| Mixture of Base oils (I) and (II) | | |
| Dynamic Viscosity*4 (cSt) | 13.5 | 14.7 |
| Aniline Point*5 (°C.) | 100.4 | 127.3 |
| Dropping Point*6 (°C.) | | |
| Just after production | 232 | 272 |
| 6 Months after production | 230 | 267 |

*1500 Neutral oil (dynamic viscosity: 10.6 centistokes (100° C.); viscosity index: 108; aniline point: 126° C.)
*2Bright stock (dynamic viscosity: 30.9 centistokes (100° C.); viscosity index: 109; aniline point: 145° C.)
*3Naphthen mineral oil (dynamic viscosity: 12.7 centistokes (100° C.); viscosity index: −38; aniline point: 67° C.)
*4Measured at 100° C.
*5Measured according to JIS K-2256
*6Measured according to JIS K-2220

The data in Comparative Example 8 establish that the utilization of base oils having a low aniline point produces a grease with a dropping point as low as 232° C. which is substantially lower than the dropping points of the greases produced by the process of the present invention.

What is claimed is:

1. A process for producing a lithium-soap grease which comprises:

adding a hydroxy-fatty acid having from 12 to 24 carbon atoms, and a dicarboxylic acid having from 8 to 10 carbon atoms to a base oil (I) having an aniline point of from 110° to 130° C. at a temperature of less than 100° C. with stirring to prepare a uniform dispersion of said acids in the base oil (I);

adding lithium hydroxide to said uniform dispersion with stirring;

reacting said acids and lithium hydroxide and dehydrating by heating to a temperature of 195° to 210° C.;

cooling the reaction mixture to a temperature not higher than about 160° C. at a cooling rate of from about 20° to 80° C./hour; and adding a base oil (II) having an aniline point of from 130° to 140° C. to the reaction mixture for a period of from 10 seconds to 30 minutes in an amount so that the weight ratio of the base oil (I) to the base oil (II) is from 30:70 to 60:40 and the resulting mixture of the base oils (I) and (II) has a dynamic viscosity as determined at 100° C. of from 5 to 50 centistokes and an aniline point of from 125° to 135° C. to produce said lithium-soap grease.

2. The process of claim 1, wherein the base oil (I) has a dynamic viscosity as determined at 100° C. of from 5 to 50 centistokes, and the base oil (II) has a dynamic viscosity as determined at 100° C. of from 5 to 50 centistokes.

3. The process of claim 1, wherein the hydroxy-fatty acid is a compound selected from the group consisting of 9-hydroxy-stearic acid, 10-hydroxy-stearic acid, 12-hydroxy-stearic acid, 12-hydroxy-behenic acid and 10-hydroxy-palmitic acid.

4. The process of claim 1, wherein the dicarboxylic acid is a compound selected from the group consisting of suberic acid, azelaic acid and sebacic acid.

5. The process of claim 1, wherein the hydroxy-fatty acid has from 16 to 22 carbon atoms and wherein said heating is to a temperature from 196° to 210° C.

6. The process of claim 1, wherein the proportion of the sum of the base oils (I) and (II) is from 70 to 94% by weight and the proportion of the total of the hydroxy-fatty acid, the dicarboxylic acid and the lithium hydroxide is about 6 to 30% by weight.

7. The process of claim 1, wherein the proportion of each component is as follows:

the sum of the base oils (I) and (II): from 70 to 94% by weight, the hydroxy-fatty acid: from 4 to 15% by weight, the dicarboxylic acid: from 1 to 10% by weight, and the lithium hydroxide: from 1 to 10% by weight.

8. The process of claim 7, wherein the hydroxy-fatty acid has from 16 to 22 carbon atoms and wherein said heating is to a temperature from 196° to 210° C.

9. The process of claim 8, wherein the total of the hydroxy-fatty acid, the dicarboxylic acid and the lithium hydroxide is from 10 to 20% by weight.

10. The process of claim 9, wherein the hydroxy-fatty acid is a compound selected from the group consisting of 9-hydroxy-stearic acid, 10-hydroxy-stearic acid, 12-hydroxy-stearic acid, 12-hydroxybehenic acid and 10-hydroxy-palmitic acid; and the dicarboxylic acid is a compound selected from the group consisting of suberic acid, azelaic acid and sebacic acid.

11. The process of claim 1 wherein said hydroxy-fatty acid has from 16 to 22 carbon atoms.

12. The process of claim 1, wherein the hydroxy-fatty acid is a compound selected from the group consisting of 9-hydroxy-stearic acid, 10-hydroxy-stearic acid, 12-hydroxy-stearic acid, 12-hydroxybehenic acid and 10-hydroxy-palmitic acid; and the dicarboxylic acid is a compound selected from the group consisting of suberic acid, azelaic acid and sebacic acid.

* * * * *